US010625282B2

(12) United States Patent
Hiemer et al.

(10) Patent No.: US 10,625,282 B2
(45) **Date of Patent: *Apr. 21, 2020**

(54) STATIC SPRAY MIXER

(75) Inventors: Andreas Hiemer, Rebstein (CH); Carsten Stemich, Düchelsdorf (DE)

(73) Assignee: SULZER MIXPAC AG, Haag (CH)

( * ) Notice: Subject to any disclaimer, the term of this patent is extended or adjusted under 35 U.S.C. 154(b) by 329 days.

This patent is subject to a terminal disclaimer.

(21) Appl. No.: 13/811,074

(22) PCT Filed: May 9, 2011

(86) PCT No.: PCT/EP2011/057379

§ 371 (c)(1),
(2), (4) Date: Jan. 18, 2013

(87) PCT Pub. No.: WO2012/010338

PCT Pub. Date: Jan. 26, 2012

(65) Prior Publication Data

US 2013/0119158 A1 May 16, 2013

(30) Foreign Application Priority Data

Jul. 20, 2010 (EP) ..... 10170141

(51) Int. Cl.
*B05B 7/04* (2006.01)
*B05B 7/08* (2006.01)
(Continued)

(52) U.S. Cl.
CPC ..... *B05B 7/04* (2013.01); *B01F 5/0641* (2013.01); *B05B 7/0861* (2013.01);
(Continued)

(58) Field of Classification Search
CPC ..... B05B 7/04; B05B 7/0861; B05B 7/0408; B05B 7/10; B05C 17/00509; B05C 17/00513; B05C 17/00553; B01F 5/0641
(Continued)

(56) References Cited

U.S. PATENT DOCUMENTS 1,000,227 A * 8/1911 Ardern ..... 239/402.5
5,636,795 A 6/1997 Sedgwick
(Continued)

FOREIGN PATENT DOCUMENTS

DE 23 56 229 A1 5/1975
EP 0 663 241 A1 7/1995
(Continued)

OTHER PUBLICATIONS

International Search Report for International Patent Application No. PCT/EP2011/057379 dated May 5, 2011.

*Primary Examiner* — Christopher S Kim
(74) *Attorney, Agent, or Firm* — Global IP Counselors, LLP

(57) ABSTRACT

A static spray mixer for the mixing and spraying of at least two flowable components is proposed having a tubular mixer housing (2) which extends in the direction of a longitudinal axis (A) up to a distal end (21) which has an outlet opening (22) for the components, having at least one mixing element (3) arranged in the mixer housing (2) for the mixing of the components as well as having an atomization sleeve (4) which has an inner surface which surrounds the mixer housing (2) in its end region, wherein the atomization sleeve (4) has an inlet channel (41) for a pressurized atomization medium, wherein a plurality of grooves (5) are provided in the outer surface of the mixer housing (2) or in the inner surface of the atomization sleeve (4) which respectively extend toward the distal end and which form separate flow channels (51) between the atomization sleeve (4) and the mixer housing (2) through which the atomization medium can flow from the inlet channel (41) of the atomization sleeve (4) to the distal end (21) of the mixer housing (2). Each flow channel has a respective changing inclination toward the longitudinal axis (A) in the direction of flow.

20 Claims, 9 Drawing Sheets

Figure 1:
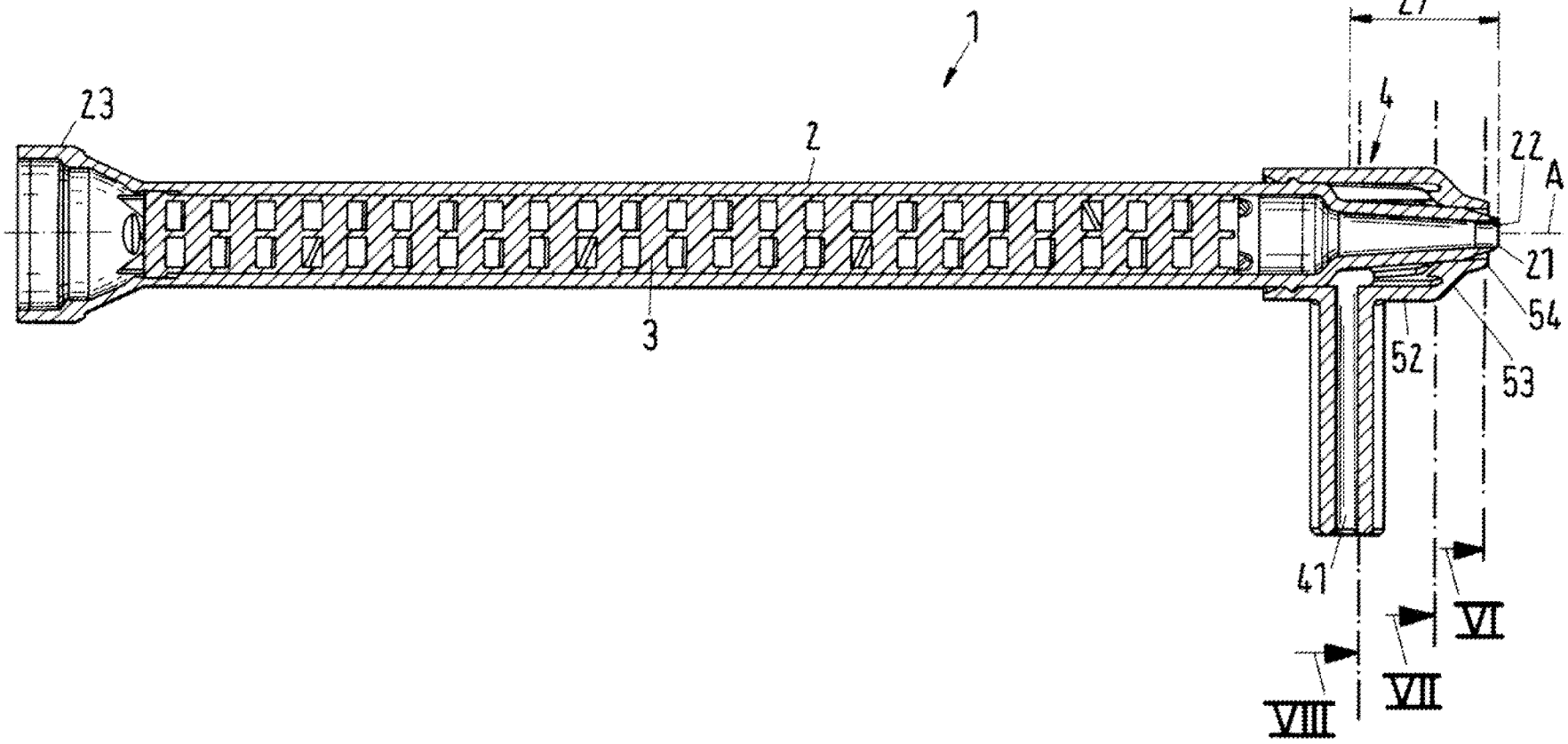

(51) Int. Cl.

| | |
|---|---|
| ***B01F 5/06*** | (2006.01) |
| ***B05B 7/10*** | (2006.01) |
| *B05C 17/005* | (2006.01) |

(52) U.S. Cl.
CPC ..... *B05B 7/0408* (2013.01); *B05B 7/10* (2013.01); *B05C 17/00509* (2013.01); *B05C 17/00513* (2013.01); *B05C 17/00553* (2013.01)

(58) Field of Classification Search
USPC ..... 239/399–406
See application file for complete search history.

(56) References Cited

U.S. PATENT DOCUMENTS

| | | | |
|---|---|---|---|
| 5,740,966 | A | 4/1998 | Blaha-Schnabel |
| 5,851,067 | A | 12/1998 | Fleischli et al. |
| 5,944,419 | A | 8/1999 | Streiff |
| 6,234,365 | B1 | 5/2001 | Bougamont et al. |
| 6,601,782 | B1 | 8/2003 | Sandholm et al. |
| 6,866,411 | B1 | 3/2005 | Stelzer et al. |
| 6,951,310 | B2 | 10/2005 | Anderson |
| 7,302,948 | B2 | 12/2007 | Anderson |
| 8,534,575 | B2 | 9/2013 | Brem |

FOREIGN PATENT DOCUMENTS

| | | | |
|---|---|---|---|
| EP | 0 749 776 | A1 | 12/1996 |
| EP | 0 815 929 | A1 | 1/1998 |
| EP | 0 904 844 | A1 | 3/1999 |
| JP | 0523266 | A | 9/1993 |
| JP | 2001523533 | A | 11/2001 |
| JP | 2005518886 | A | 6/2005 |
| JP | 2006247619 | A | 9/2006 |
| JP | 2007244997 | A | 9/2007 |
| RU | 2245188 | C2 | 1/2005 |
| WO | 2010048734 | A1 | 5/2010 |

* cited by examiner

STATIC SPRAY MIXER

PRIORITY CLAIM

The present application is a National Stage of International Application No. PCT/EP2011/057379, filed on May 9, 2011, which claims priority to European Patent Application No. 10170141.5 filed on Jul. 20, 2010, the entire contents of which are being incorporated herein by reference.

The invention relates to a static spray mixer for the mixing and spraying of at least two flowable components in accordance with the preamble of the independent claim.

Static mixers for the mixing of at least two flowable components are described, for example, in EP-A-0 749 776 and in EP-A-0 815 929. These very compact mixers provide good mixing results, in particular also on the mixing of high-viscosity materials such as sealing compounds, two-component foams or two-component adhesives, despite a simple, material-saving design of their mixer structure. Such static mixers are usually designed for single use and are frequently used for products to be hardened in which the mixer can practically no longer be cleaned.

In some applications in which such static mixers are used, it is desirable to spray the two components onto a substrate after their mixing in the static mixer. For this purpose, the mixed components are atomized at the outlet of the mixer by the action of a medium such as air and can then be applied to the desired substrate in the form of a spray jet or spray mist. In particular more highly viscous coating media, e.g. polyurethane, epoxy resins or similar, can also be processed using this technology.

An apparatus for such applications is disclosed, for example, in U.S. Pat. No. 6,951,310. In this apparatus, a tubular mixer housing is provided which receives the mixing element for the static mixing and which has an external thread at one end onto which a ring-shaped nozzle body is screwed. The nozzle body likewise has an external thread. A conical atomizer element which has a plurality of grooves extending in the longitudinal direction on its cone surface is placed onto the end of the mixing element and projects out of the mixer housing. A cap is pushed over this atomizer element and its inner surface is likewise of conical design so that it contacts the cone surface of the atomizer element. The grooves consequently form flow channels between the atomizer element and the cap. The cap is fixed to the nozzle body together with the atomizer element by means of a retaining nut which is screwed onto the external thread of the nozzle body. The nozzle body has a connection for compressed air. In operation, the compressed air flows out of the nozzle body through the flow channels between the atomizer element and the cap and atomizes the material being discharged from the mixing element.

Even though this apparatus has proved to be absolutely functional, its structure is very complex and the installation is complicated and/or expensive so that the apparatus is in particular not very cost-effective with respect to the single use.

A static spray mixer of much simpler construction is disclosed in the European patent application No. 09168285 of Sulzer Mixpac AG. In this spray mixer, the mixer housing and the atomization nozzle are each configured in one piece, with the grooves forming the flow channels being provided in the inner surface of the atomization sleeve or in the outer surface of the mixer housing.

Starting from this prior art, it is an object of the invention to propose a different static spray mixer for the mixing and spraying of at least two flowable components which is cost-effective in its manufacture and enables an efficient mixing or thorough mixing and atomization of the components.

The subject of the invention satisfying this object is characterized by the features of the independent claim.

In accordance with the invention, a static spray mixer is therefore proposed for the mixing and spraying of at least two flowable components having a tubular mixer housing which extends in the direction of a longitudinal axis up to a distal end which has an outlet opening for the components, having at least one mixing element arranged in the mixer housing for mixing the components and having an atomization sleeve which has an inner surface which surrounds the mixer housing in its end region, wherein the atomization sleeve has an inlet channel for a pressurized atomization medium, wherein a plurality of grooves are provided in the outer surface of the mixer housing or in the inner surface of the atomization sleeve which each extend to the distal end and which form separate flow channels between the atomization sleeve and the mixer housing through which the atomization medium can flow from the inlet channel of the atomization sleeve to the distal end of the mixer housing. Each flow channel has a respective changing inclination toward the longitudinal axis in the direction of flow.

The flow relationships of the atomization medium can be optimized by the measure of not keeping the inclination of the flow channels constant over their extent, viewed in the axial direction, but rather of changing it in order thus to achieve a particularly uniform and stable effect of the atomization medium onto the mixed components, from which in particular a higher reproducibility of the process also results.

Since the flow channels are moreover provided in the mixer housing or in the atomization sleeve, a particularly simple structure of the static spray mixer results without compromises in the quality of the mixing or in the atomization being required for this purpose. The ideal use of the individual components allows a cost-effective and economic manufacture of the spray mixers which can moreover be carried out in an—at least largely—automated manner. The static spray mixer in accordance with the invention in principle requires only three components, namely the one-piece mixer housing, the atomizer sleeve and the mixing element, which can likewise be designed in one piece. Low complexity and a simple manufacture and/or assembly results from this.

In a first preferred embodiment, the changing inclination of the flow channels is realized in that each groove has three sections arranged after one another, viewed in the direction of flow, wherein the middle section has an inclination toward the longitudinal axis which is larger than the inclination of the two adjacent sections. In this respect, it is particularly preferred if the middle section has an inclination toward the longitudinal axis which is larger than 45° and in particular amounts to less than 50°.

In a second preferred embodiment, the changing inclination is realized in that each groove has a section, viewed in the direction of flow, in which the inclination toward the longitudinal axis changes continuously. In this section, the base of the respective groove is thus configured as curved, which can in particular be realized in that the inner surface of the atomization sleeve or the outer surface of the mixer housing is designed as curved, viewed in the direction of the longitudinal axis.

An advantageous measure lies in the fact that the mixer housing has a distal end region which tapers toward the distal end and wherein the inner surface of the atomization sleeve is designed for cooperation with the distal end region. The atomization effect is improved by this tapering.

The outer surface of the mixer housing in the distal end region is preferably at least partly configured as a frusto-conical surface or as a surface curved in the axial direction to realize a particularly good cooperation with the atomization sleeve.

It has proved to be advantageous with respect to a uniform atomization if the distal end of the mixer housing projects beyond the atomization sleeve.

To enable an energy effect of the atomization medium onto the components to be atomized which is as large as possible, the flow channels are preferably configured in accordance with the principle of a Laval nozzle with a flow cross-section which, viewed in the direction of flow, first tapers and subsequently flares. An additional acceleration of the atomization medium, for example to supersonic speed, results from this measure, from which the higher energy input results.

An advantageous measure for realizing the principle of a Laval nozzle is the fact that the grooves, viewed in the direction of flow, narrow with respect to the peripheral direction. In this respect, the peripheral direction means that direction in which the inner surface of the atomization sleeve or the outer surface of the mixer housing extends in the direction perpendicular to the longitudinal axis.

Such a narrowing can also advantageously be achieved in that each groove is bounded by two walls of which at least one is configured as curved, viewed in the direction of flow.

It is furthermore preferred if the extent of the grooves also has a component in the peripheral direction. The atomization medium can be set into a rotational movement about the longitudinal axis by this measure on flowing through the flow channels. It has been shown that this swirl has a stabilizing effect on the flow of the atomization medium exiting at the distal end of the mixer housing, which has an advantageous effect on a uniform and reproducible spraying.

A possible embodiment lies in the fact that the grooves have a substantially spiral extent with respect to the longitudinal axis A.

In particular to simplify the manufacture even further, it is advantageous if the atomization sleeve is connected in a thread-free manner to the mixer housing; for example, the atomization sleeve is fastened to the mixer housing by means of a sealing snap-in connection It is very particularly advantageous with respect to the realization of a stabilizing swirl of the atomization medium if the inlet channel is arranged asymmetrically with respect to the longitudinal axis. A rotational movement from which a swirl of the atomization medium results is already generated on the inflow of the atomization medium into the atomization sleeve due to this measure.

The inlet channel preferably opens into the inner surface of the atomization sleeve perpendicular to the longitudinal axis for this purpose.

Further advantageous measures and embodiments of the invention result from the dependent claims.

Figure 2:
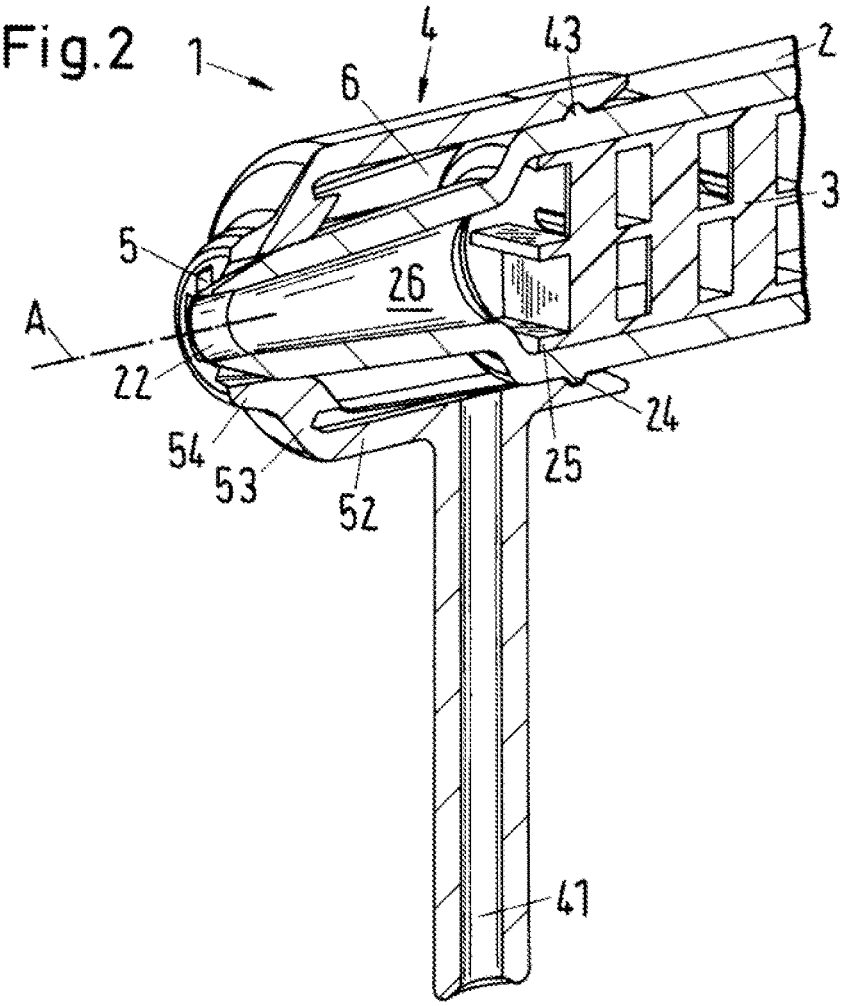
Figure 5:
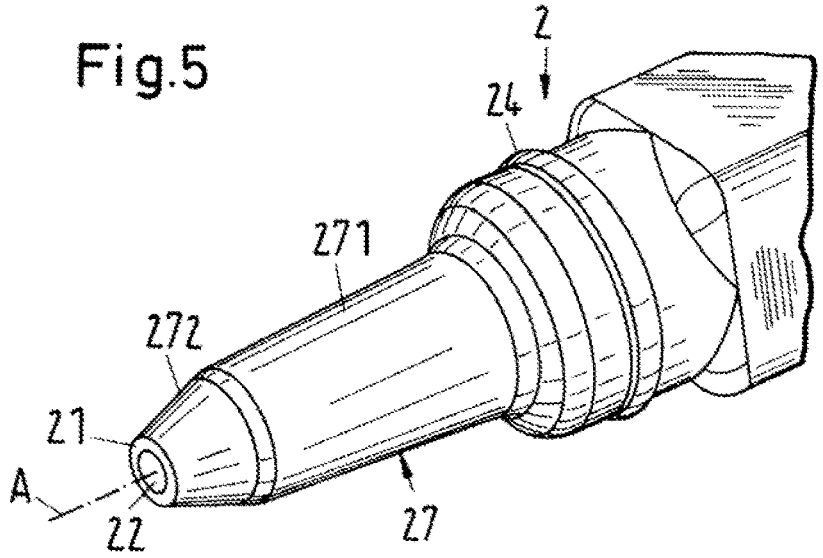
Figure 3:
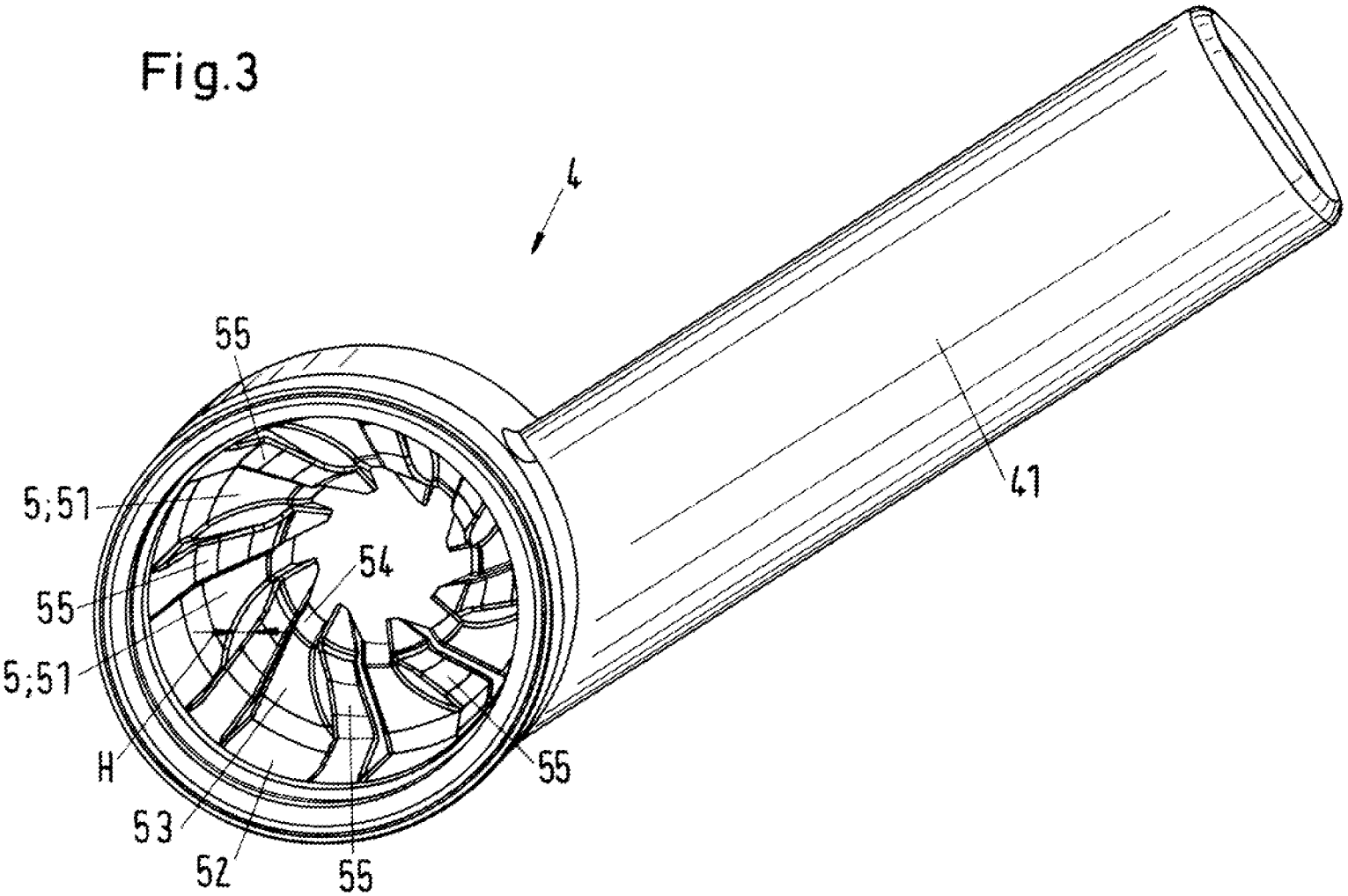
Figure 4:
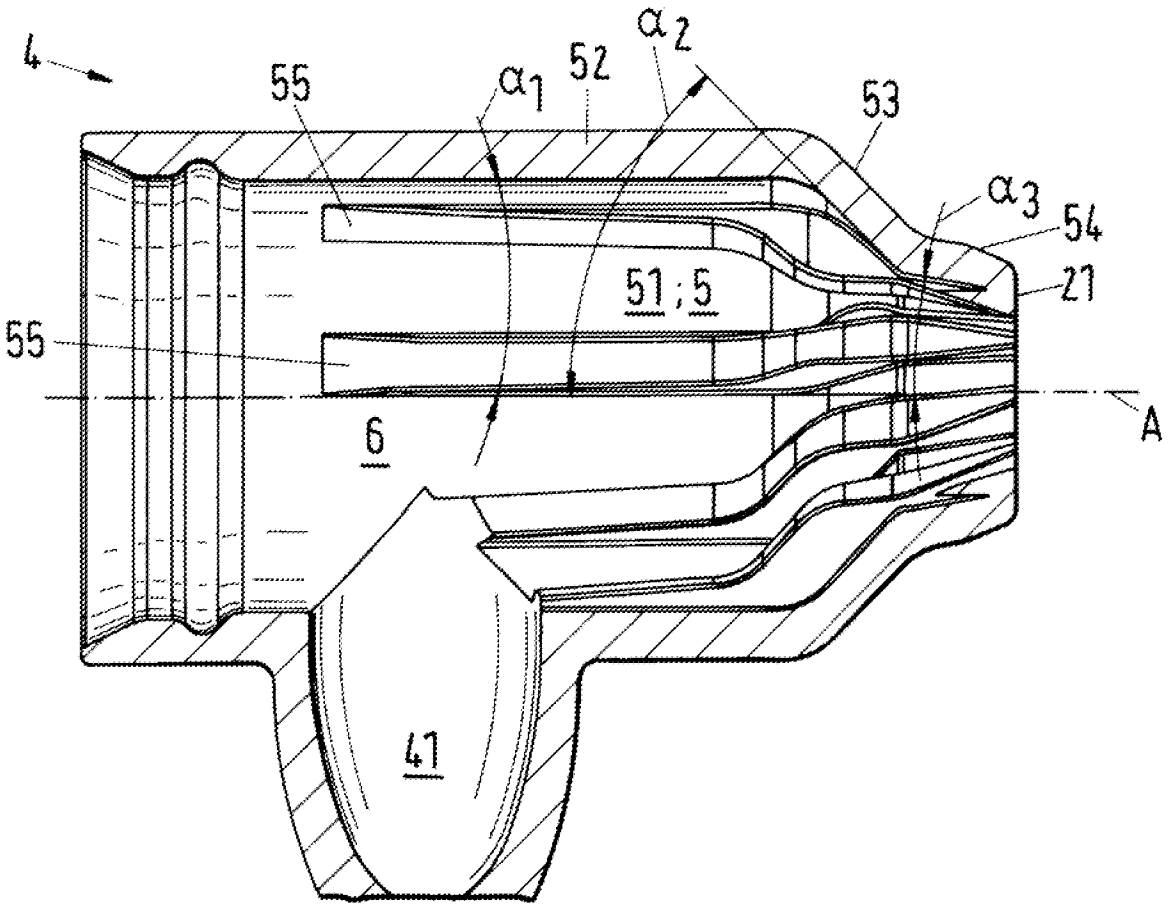
Figure 6:
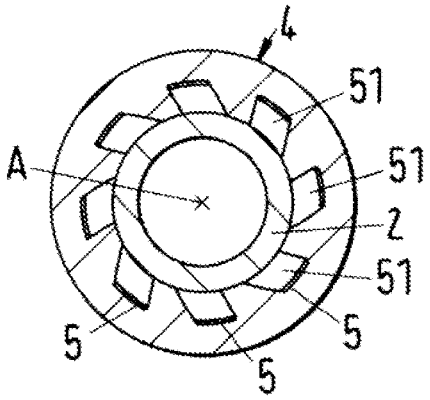
Figure 7:
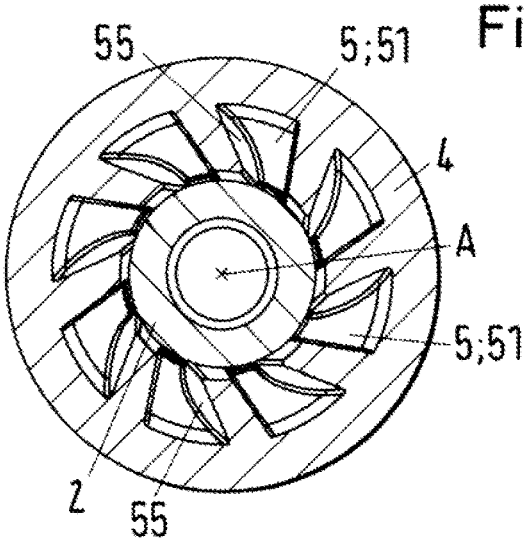
Figure 8:
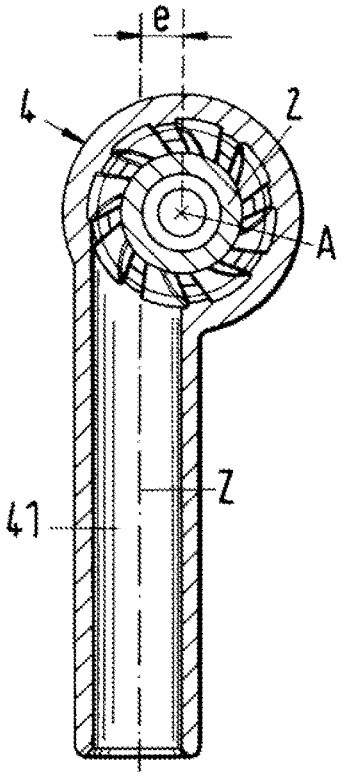
Figure 9:
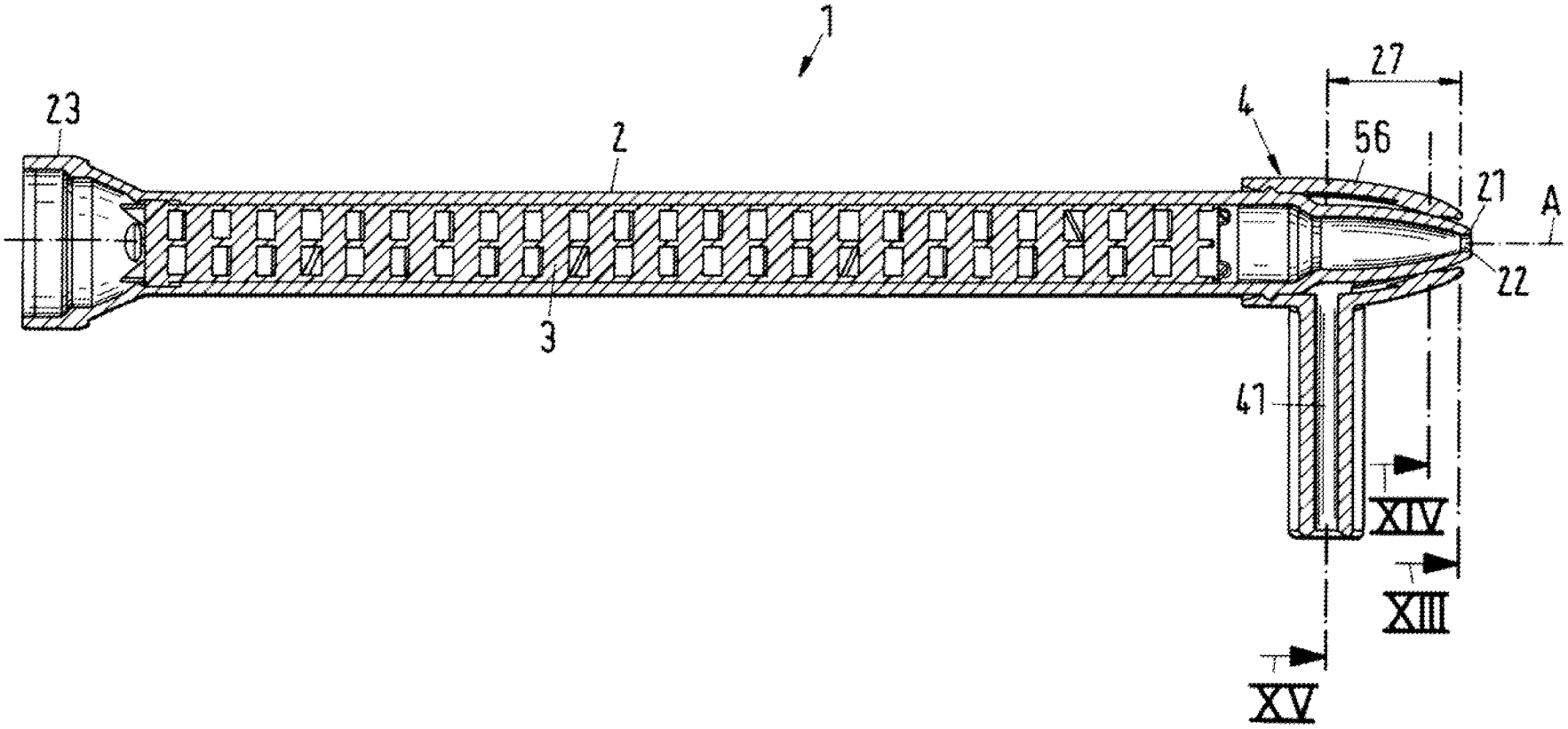
Figure 10:
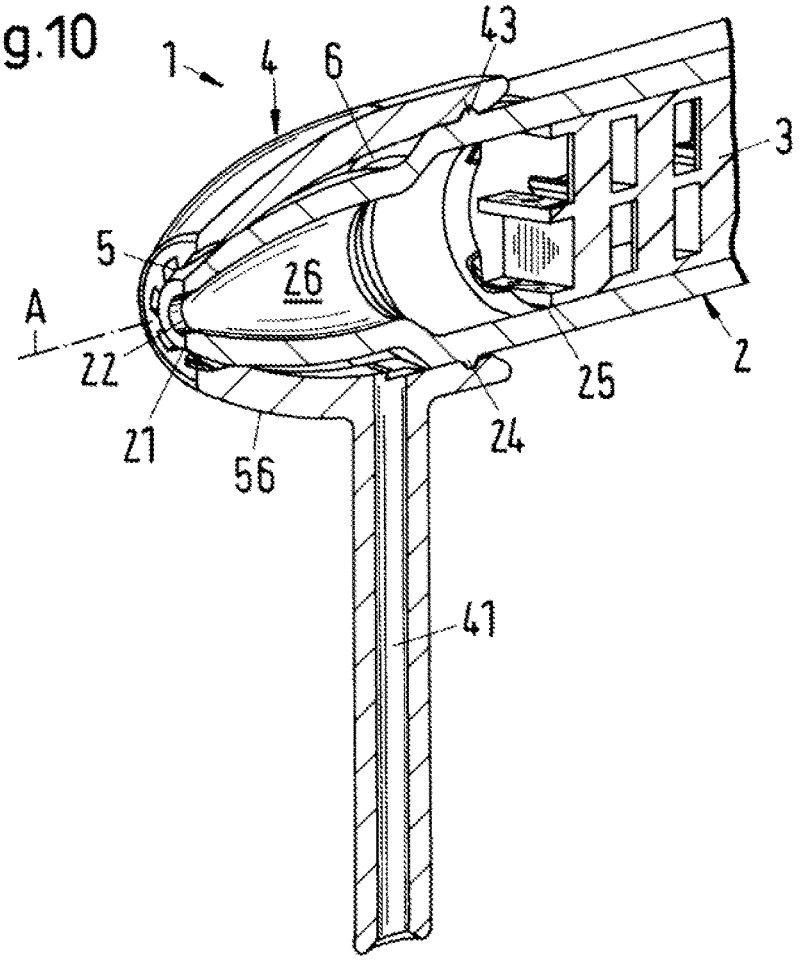
Figure 12:
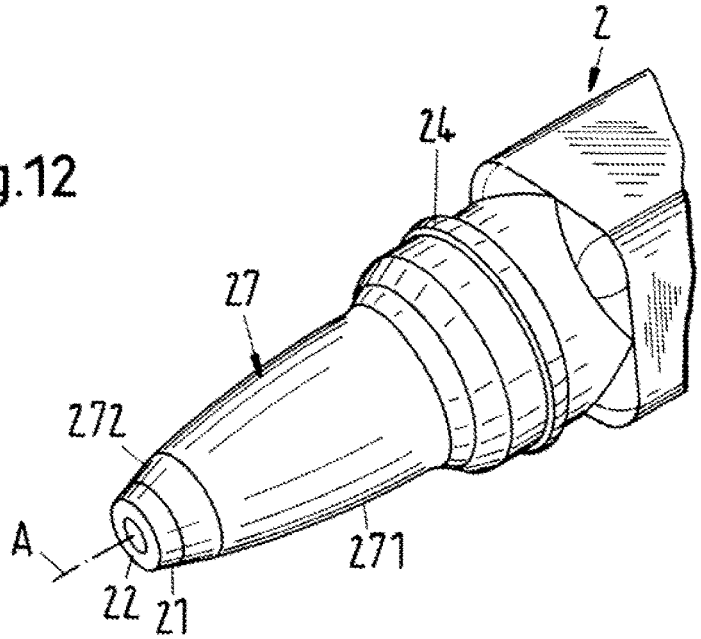
Figure 11:
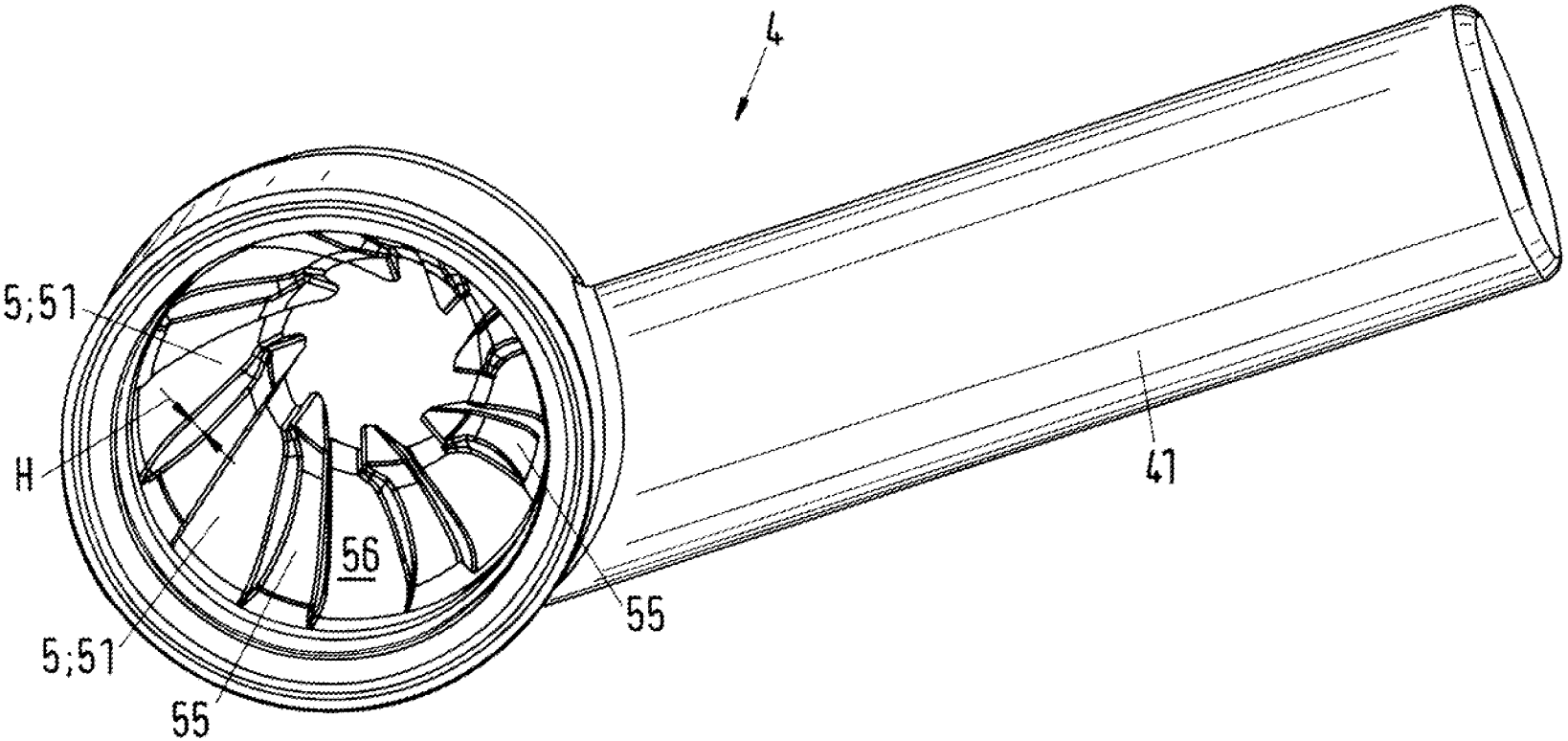
Figure 13:
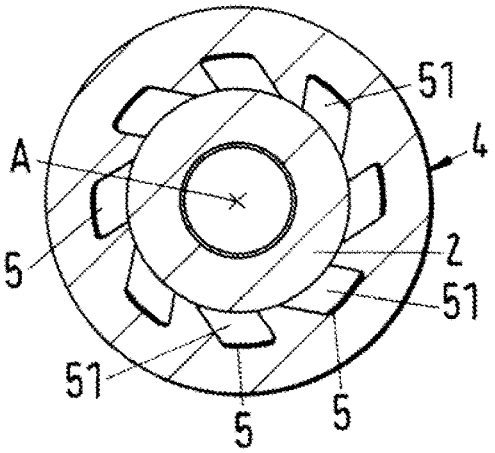
Figure 14:
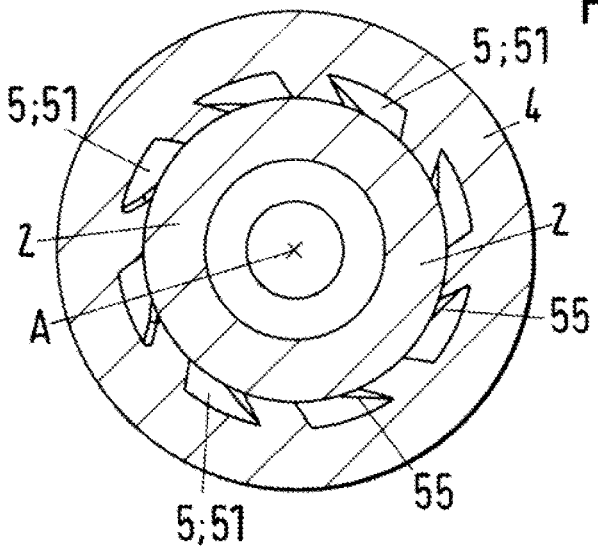
Figure 15:
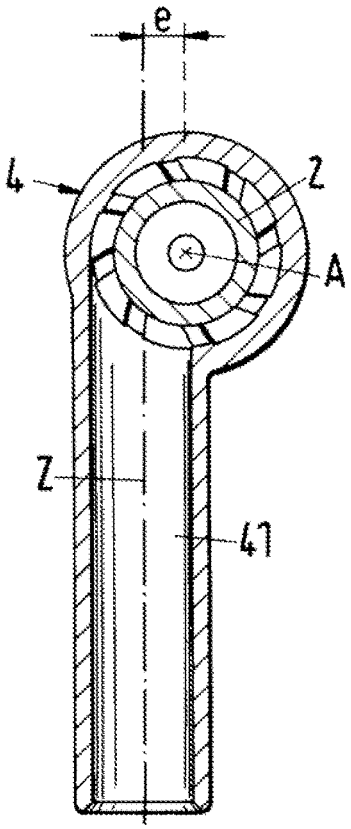

The invention will be explained in more detail in the following with reference to embodiments and to the drawing. There are shown in the schematic drawing, partly in section:

FIG. 1: a longitudinal section of a first embodiment of a static spray mixer in accordance with the invention;

FIG. 2: a perspective sectional representation of the distal end region of the first embodiment;

FIG. 3: a perspective representation of the atomization sleeve of the first embodiment;

FIG. 4: a longitudinal section through the atomization sleeve of the first embodiment FIG. 5: a perspective representation of the distal end region of the mixer housing of the first embodiment;

FIG. 6: a cross-section through the first embodiment along the line VI-VI in FIG. 1;

FIG. 7: a cross-section through the first embodiment along the line VII-VII in FIG. 1;

FIG. 8: a cross-section through the first embodiment along the line VIII-VIII in FIG. 1;

FIG. 9: a longitudinal section of a second embodiment of a static spray mixer in accordance with the invention, analog to FIG. 1;

FIG. 10: a perspective sectional representation of the distal end region of the second embodiment;

FIG. 11: a perspective representation of the atomization sleeve of the second embodiment;

FIG. 12: a perspective representation of the distal end region of the mixer housing of the second embodiment;

FIG. 13: a cross-section through the second embodiment along the line XIII-XIII in FIG. 9;

FIG. 14: a cross-section through the second embodiment along the line XIV-XIV in FIG. 9; and FIG. 15: a cross-section through the second embodiment along the line XV-XV in FIG. 9.

FIG. 1 shows a longitudinal section of a first embodiment of a static spray mixer in accordance with the invention which is designated as a whole by the reference numeral 1. The spray mixer serves for the mixing and spraying of at least two flowable components. FIG. 2 shows a perspective representation of the distal end region of the first embodiment.

Reference is made in the following to the case particularly relevant to practice that precisely two components are mixed and sprayed. It is, however, understood that the invention can also be used for the mixing and spraying of more than two components.

The spray mixer 1 includes a tubular, one-piece mixer housing 2 which extends in the direction of a longitudinal axis A up to a distal end 21. In this respect, that end is meant by the distal end 21 at which the mixed components exit the mixer housing 2 in the operating state. The distal end 21 is provided with an outlet opening 22 for this purpose. The mixer housing 2 has a connection piece 23 at the proximal end, which means the end at which the components to be mixed are introduced into the mixer housing 2, and the mixer housing 2 can be connected to a storage container for the components by means of said connection piece. This storage container can, for example, be a two-component cartridge known per se, can be designed as a coaxial cartridge or a side-by-side cartridge or can be two tanks in which the two components are stored separately from one another. The connection piece is designed, depending on the design of the storage container or of its outlet, e.g. as a snap-in connection, as a bayonet connection, as a threaded connection or combinations thereof.

At least one static mixing element 3 is arranged in a manner known per se in the mixer housing 2 and contacts the inner wall of the mixer housing 2 so that the two components can only move from the proximal end to the outlet opening 22 through the mixing element 3. Either a plurality of mixing elements 3 arranged after one another can be provided or, as in the present embodiment, a one-piece mixing element 3 which is preferably injection molded and is made of a thermoplastic. Such static mixers or mixing elements 3 are sufficiently known per se to the skilled person and do not therefore require any further explanation.

Such mixers or mixing elements 3 are in particular suited such as are sold under the brand name QUADRO® by the company Sulzer Chemtech AG (Switzerland). Such mixing elements are described, for example, in the already cited documents EP-A-0 749 776 and EP-A-0 815 929. Such a mixing element 3 of the Quadro® type has a rectangular cross-section, in particular a square cross-section, perpendicular to the longitudinal direction A. Accordingly, the one-piece mixer housing 2 also has a substantially rectangular, in particular square, cross-sectional surface perpendicular to the longitudinal axis A, at least in the region in which it surrounds the mixing element 3.

The mixing element 3 does not extend fully up to the distal end 21 of the mixer housing 2, but rather ends at an abutment 25 (see FIG. 2) which is here realized by the transition of the mixer housing 2 from a square cross-section to a round cross-section. Viewed in the direction of flow, the inner space of the mixture housing 2 therefore has a substantially square cross-section for the reception of the mixing element 3 up to this abutment 25. At this abutment 25, the inner space of the mixer housing 2 merges into a circular conical shape which realizes a tapering in the mixer housing 2. Here, the inner space therefore has a circular cross-section and forms a outlet region 26 which tapers in the direction of the distal end 21 and opens into the outlet opening 22 there.

The static spray mixer 1 furthermore has an atomization sleeve 4 which has an inner surface which surrounds the mixer housing 2 in its end region. The atomization sleeve 4 is designed in one piece and is preferably injection molded, in particular from a thermoplastic. It has an inlet channel 41 for a pressurized atomization medium which is in particular gaseous. The atomization medium is preferably compressed air. The inlet channel 41 can be designed for all known connections, in particular also for a Luer lock.

To enable a particularly simple installation or manufacture, the atomization sleeve 4 is preferably connected to the mixer housing in a thread-free manner, in the present embodiment by means of a snap-in connection. For this purpose, a flange-like raised portion 24 is provided at the mixer housing 2 (see FIG. 2) and extends over the total periphery of the mixer housing 2. A peripheral groove 43 is provided at the inner surface of the atomization sleeve 4 and is designed for cooperation with the elevated portion 24. If the atomization sleeve 4 is pushed over the mixer housing 2, the elevated portion 24 snaps into the peripheral groove 43 and provides a stable connection of the atomization sleeve 4 to the mixer housing 2. This snap-in connection is preferably designed in a sealing manner so that the atomization medium, here the compressed air—cannot escape through this connection including the peripheral groove 43 and the elevated portion 24. The inner surface of the atomization sleeve 4 furthermore lies tightly on the outer surface of the mixer housing 2 in a region between the opening of the inlet channel 41 and of the elevated portion 24 so that a sealing effect is also hereby achieved which prevents a leak or a backflow of the atomization medium.

It is naturally also possible to arrange additional sealants, for example an O ring, between the mixer housing 2 and the atomization sleeve 4.

Alternatively to the embodiment shown, it is also possible to provide a peripheral groove at the mixer housing 2 and to provide an elevated portion which engages into this peripheral groove at the atomization sleeve 4.

The connection between the atomization sleeve 4 and the mixer housing 2 is preferably configured so that the atomization sleeve 4 connected to the mixer housing 2 is rotatable about the longitudinal axis A. This is, for example, ensured with a snap-in connection with the completely circumferential peripheral groove 43 and the elevated portion 24. The rotatability of the atomization sleeve 4 has the advantage that the inlet channel 41 can always be aligned so that it can be connected as simply as possible to a source for the atomization medium.

A plurality of grooves 5 are provided in the outer surface of the mixer housing 2 or in the inner surface of the atomization sleeve 4 which each extend toward the distal 21 end and which form separate flow channels 51 between the atomization sleeve 4 and the mixer housing 2 through which the atomization medium can flow from the inlet channel 41 of the atomization sleeve 4 to the distal end 21 of the mixer housing 2. In the embodiment described here, the grooves 5 are provided in the inner surface of the atomization sleeve 4; they can naturally also be provided in accordingly the same manner alternatively or additionally in the outer surface of the mixer housing 2.

The grooves 5 can be configured as curved, for example arcuate, or also as a straight line or also by combinations of curved and straight-line sections.

For the better understanding of the extent of the grooves 5, FIG. 3 shows a perspective representation of the atomization sleeve 4 of the first embodiment, with the view into the atomization sleeve 4 taking place in the direction of flow. A longitudinal section through the atomization sleeve 4 is shown in FIG. 4

In accordance with the invention, each flow channel 51 or the associated grooves 5 are designed so that, viewed in the direction of flow, it in each case has a changing inclination toward the longitudinal axis A. In the first embodiment, this is realized so that each groove 5 includes, viewed in the direction of flow, three sections 52, 53, 54 arranged after one another (see also FIG. 3 and FIG. 4), wherein the middle section 53 has an inclination $\alpha_2$ to the longitudinal axis A which is larger than the inclination $\alpha_1$, $\alpha_3$ of the two adjacent sections 52 and 54. In the sections 52, 53 and 54, the inclination of the grooves 5 with respect to the longitudinal axis A is constant in each case. In the section 52 which is first viewed in the direction of flow and which is located adjacent to the opening of the inlet channel 41, the inclination $\alpha$ can also be zero (see FIG. 4), that is this section 52 can extend parallel to the longitudinal axis A viewed in the direction of the longitudinal axis A. The base of each groove 5 is thus in each case part of a conical or frustoconical surface in the sections 53, 54 and optionally also in the first section 52, with the conical angle $\alpha_2$ being larger in the middle section 53 than the conical angle $\alpha_1$, $\alpha_3$ in the adjacent sections 52 and 53. In the first section 52, the inclination with respect to the longitudinal axis can—as already mentioned—also be zero. In this case, the grooves 5 in this first section 52 are each part of a cylindrical surface; the angle $\alpha_1$ has the value 0°. In the middle section 53, which has the largest inclination with respect to the longitudinal axis A, the inclination $\alpha_2$ is preferably larger than 45° and smaller than 50°. In the embodiment shown here, the inclination $\alpha_2$ toward the longitudinal axis A in the middle section is 46°. In the first section 52, the inclination $\alpha$ here amounts to 0°. In the third section 54 which is at the distal end 21, the inclination $\alpha_3$ toward the longitudinal axis A is preferably smaller than 20°; in the present example, it amounts to approximately 10° to 11°.

Each of the grooves 5 is laterally bounded by two respective walls which are formed by ribs 55 which are each arranged between two adjacent grooves 5. As can in particular be seen from FIG. 3 and FIG. 4, these ribs 55 change their height H, viewed in the direction of flow, by which their extent in the radial direction perpendicular to the longitudinal axis A is meant. The ribs start in the region of the opening of the inlet passage 41 or in the first section 52 with a height of zero and then rise continuously until they have reached their maximum height in the middle section 53.

FIG. 5 shows a perspective representation of the distal end region 27 of the mixer housing 2 with the distal end 21. The distal end region 27 of the mixer housing 2 tapers toward the distal end 21. In the first embodiment, the distal end region 27 has a conical configuration and includes two regions arranged after one another, viewed in the direction of the longitudinal axis A, namely a flat region 271 arranged upstream and a steeper region 272 adjoining it. Both regions 271 and 272 are each of conical configuration, that is the outer surface of the mixer housing 2 is respectively configured as a frustoconical surface in the regions 271 and 272, with the conical angle of the flat region 271 measured against the longitudinal axis being smaller than the conical angle of the steeper region 272 measured against the longitudinal axis A. The function of this construction measure will be explained further below.

It is alternatively also possible that the flat region 271 is configured with a conical angle of 0°, that is the flat region 271 is then of cylindrical design. In the flat region 271, the outer surface of the mixer housing 2 is then the jacket surface of a cylinder whose cylinder axis coincides with the longitudinal axis A.

As FIG. 1 also shows, the distal end 21 of the mixer housing 2 shown in FIG. 5 projects beyond the atomization sleeve 4.

To make the exact extent of the grooves 5 of the first embodiment even clearer, in addition to FIGS. 3 and 4, a respective cross-section perpendicular to the longitudinal axis is shown in FIGS. 6-8, and indeed in FIG. 6 along the line VI-VI in FIG. 1; in FIG. 7 along the line VII-VII; and in FIG. 8 along the line VIII-VIII in FIG. 1.

The inner surface of the atomization sleeve 4 is designed to cooperate with the distal end region 27 of the mixer housing 2. The ribs 55 of the atomization sleeve 4 provided between the grooves 5 and the outer surface of the mixer housing 2 lie close and sealingly with respect to one another so that the grooves 5 form a respective separate flow channel 51 between the inner surface of the atomization sleeve 4 and the outer surface of the mixer housing 2 (see FIG. 6).

Further upstream, in the region of the opening of the inlet channel 41 (see also FIG. 4), the height H of the ribs 55 is so small that a ring space 6 is present between the outer surface of the mixer housing 2 and the inner surface of the atomizer sleeve 4. The ring space 6 is in flow communication with the inlet channel 41 of the atomizer sleeve 4. The atomization medium can move out of the inlet channel 41 into the separate flow channels 51 through the ring space 6. In this respect, the height H of the ribs 55 within the ring space 6 is not necessarily zero everywhere. As can in particular be recognized from FIGS. 4 and 8, all or some of the ribs 55 in the ring space 6 can have a height H different from zero so that they project into the ring space with respect to the radial direction perpendicular to the longitudinal axis A without, however, contacting the outer surface of the mixer housing 2 in this region in so doing.

The grooves 5, there are eight grooves 5 in this embodiment, are distributed uniformly over the inner surface of the atomization sleeve 4. It has proved to be advantageous with respect to an atomization which is as complete and as homogeneous as possible of the mixed components exiting the outlet opening if the compressed air flows generated by the grooves 5 have a swirl, that is a rotation on a helical line about a longitudinal axis A. This swirl effects a considerable stabilization of the compressed air flow. The circulating atomization medium, here compressed air, generates a jet which is stabilized by the swirl and thus acts uniformly on the mixed components exiting the outlet opening 22. A very uniform and in particular reproducible spray pattern results from this. A compressed air jet which is as conical as possible and which is stabilized by the swirl is particularly favorable in this respect. A significantly smaller spray loss (overspray) results on application due to this extremely uniform and reproducible air flow.

The individual compressed air jets (or jets of the atomization medium) exiting the respective separate flow channels 51 at the distal end 21 are first formed as discrete individual jets on their exit which then combine to form a uniform stable total jet due to their swirl property, said total jet atomizing the mixed components exiting the mixer housing. This total jet preferably has a conical extent.

A plurality of measures are provided to generate the swirl in the flow of the atomization medium. The grooves 5 which form the flow channels 51 do not extend exactly in the axial direction defined by the longitudinal axis A or do not only extend inclined toward the longitudinal axis, but the extent of the grooves 5 also has a component in the peripheral direction of the atomization sleeve 4. This can in particular be seen from the representation in FIG. 3 and in FIG. 6. In addition to the inclination toward the longitudinal axis A, the extent of the grooves 5 is at least approximately spiral or helical about the longitudinal axis A. A further measure which supports the formation of the swirl is realized by the design of the ribs 55 which form the walls of the grooves 5. As can best be seen from FIG. 3 and FIG. 7, the ribs 55 are designed so that one of the two walls which each laterally bound the grooves 5 is configured as curved or as approximately curved by a frequency polygon, viewed in the direction of flow, at least in the middle section 53. The respective other wall is linear, but extends so obliquely to the longitudinal axis A that it has a respective component in the peripheral direction. The generation of the swirl can be positively influenced by the curvature of the one wall.

A further measure for generating the swirl which can also be realized completely independently of the other design of the static spray mixer is to arrange the inlet channel 41 through which the atomization medium moves into the flow channels 51 asymmetrically with respect to the longitudinal axis A. This measure can best be recognized in FIG. 8. The inlet channel 41 has a central axis Z. The inlet channel 41 is arranged so that its central axis Z does not intersect the longitudinal axis A, but rather has a perpendicular spacing e from the longitudinal axis A. This asymmetrical or also eccentric arrangement of the inlet channel 41 with respect to the longitudinal axis A has the result that the atomization medium, that is here the compressed air, is set into a rotational or swirl movement about the longitudinal axis A on its entry into the ring space 6. The inlet channel 41 is preferably arranged—as shown in FIG. 8—so that it opens into the inner surface of the atomization sleeve 4 perpendicular to the longitudinal axis A. Such embodiments are naturally also possible in which the inlet channel 41 opens at an angle different from 90°, that is obliquely to the longitudinal axis A.

To increase the energy input from the atomization medium to the components exiting the outlet opening 22, it is a particularly advantageous measure to configure the flow channels 51 in accordance with the principle of a Laval nozzle having a flow cross-section first narrowing and subsequently flaring, viewed in the direction of flow. To realize this narrowing of the flow cross-section, two dimensions are available, namely the two directions of the plane perpendicular to the longitudinal axis A. The one direction is called the radial direction, by which the direction is meant which stands perpendicular on the longitudinal axis A and which faces outwardly radially from the longitudinal axis A. The other direction is called the peripheral direction, by which the direction is meant which stands perpendicular both on the direction defined by the longitudinal axis A and on the radial direction. The extent of the flow channels 51 in the radial direction is called their depth.

The principle of the Laval nozzle can be realized with respect to the radial direction in that the depth of the flow channels 51 greatly reduces in the middle steep section 53. The depth becomes minimal where the transition from the flat region 271 into the steeper region 272 takes place at the mixer housing 2. Downstream of this transition, the depth of the flow channels 51 increases again, mainly due to the fact that here the outer surface of the mixer housing 2 is part of a steeper truncated cone and the inclination of the inner surface of the atomization sleeve 4 remains substantially constant in the third section 54. A Laval nozzle can be achieved with respect to the radial direction by this measure.

In addition or also alternatively, the flow channels 51 can also be configured in accordance with the principle off a Laval nozzle with respect to the peripheral direction. This can best be recognized in the representation of FIG. 3. The grooves 5 are configured in the middle section 53 so that they narrow with respect to the peripheral direction, viewed in the direction of flow. This is realized in that the walls of the grooves 5 formed by the ribs 55 do not extend in parallel for each groove 5, but the one wall extends toward the other so that a reduction in the extent of the groove 5 takes place in the peripheral direction. As already mentioned above, in the embodiment described here, the one wall in each groove 5 is designed as linear, whereas the other wall is configured as curved, viewed in the direction of flow, such that the flow channel 51 narrows with respect to the peripheral direction.

The air used as the atomization medium can also additionally be acted on by kinetic energy downstream of the narrowest point and can thus be accelerated by the configuration of the grooves 5 or of the flow channels 51 in accordance with the principle of a Laval nozzle. This is done as with a Laval nozzle by the flow cross-section again widening in the direction of flow. A higher energy input into the components to be atomized results from this. In addition, the jet is stabilized by this realization of the Laval principle. The diverging opening, that is the opening which widens again, of the respective flow channel 51 moreover has the positive effect of an avoidance or of at least of a considerable reduction of fluctuations in the jet.

In operation, this first embodiment works as follows. The static spray mixer is connected by means of its connection piece 23 to a storage vessel which contains the two components separate from one another, for example with a two-component cartridge. The inlet channel 41 of the atomization sleeve 4 is connected to a source for the atomization medium, for example to a compressed air source. The two components are now dispensed, move into the static spray mixer 1 and are there intimately mixed by means of the mixing element 3. After flowing through the mixing element 3, the two components move as a homogeneously mixed material through the outlet region 26 of the mixer housing 2 to the outlet opening 22. The compressed air flows through the inlet channel 41 of the atomization sleeve 4 into the ring space 6 between the inner surface of the atomization sleeve 4 and the outer surface of the mixer housing 2, has a swirl imparted onto it in this process by the asymmetrical arrangement and moves from there through the grooves 5 which form the flow channels 51 to the distal end 21 and thus to the outlet opening 22 of the mixer housing 3. The compressed air flow stabilized by the swirl here impacts the mixed material exiting the outlet opening 22, atomizes it uniformly and transports it as a spray jet to the substrate to be treated or to be coated. Since the dispensing of the components from the storage vessel takes place with compressed air or supported by compressed air in some applications, the compressed air can also be used for the atomization.

An advantage of the static spray mixer 1 in accordance with the invention is to be seen in its particularly simple construction and manufacture. In principle, only three parts are required in the embodiment described here, namely a one-piece mixer housing 2, a one-piece mixing element 3 and a one-piece atomization sleeve 4, with each of these parts being able to be manufactured in a simple and economic manner by means of injection molding. The particularly simple construction also enable an—at least largely—automated assembly of the parts of the static spray mixer 1. In particular no screw connections of these three parts is necessary.

It is advantageous with respect to a particularly simple and cost-effective manufacture if the mixer housing and/or the atomization sleeve are injection molded, preferably from a thermoplastic.

For the same reason, it is advantageous if the mixing element is designed in one piece and is injection molded, preferably from a thermoplastic.

In the following, a second embodiment of the static spray mixer in accordance with the invention will be explained with reference to FIGS. 9-15. In this respect, only the major differences in comparison with the first embodiment will be looked at. In the second embodiment, parts having the same or an equivalent function are provided with the same reference numerals as in the first embodiment. The explanations given with respect to the first embodiment as well as the measures and variants explained with reference to the first embodiment also apply in accordingly the same manner to the second embodiment.

FIG. 9 shows a longitudinal section of the second embodiment analog to FIG. 1. FIG. 10 shows a perspective sectional representation of the distal end region of the second embodiment. In FIG. 11, in an analog manner to FIG. 3, a perspective representation of the atomization sleeve 4 is shown, with the view taking place in the direction of flow into the atomization sleeve. FIG. 12 shows the distal end region 27 of the mixer housing in a representation analog to FIG. 5. To make the exact extent of the grooves 5 of the second embodiment even clearer, in addition to FIG. 11, a respective cross-section perpendicular to the longitudinal axis A is shown in FIGS. 13-15, and indeed in FIG. 13 along the line XIII-XIII in FIG. 9; in FIG. 14 along the line XIV-XIV; and in FIG. 15 along the line XV-XV in FIG. 9.

In the second embodiment, the changing inclination of the flow channels 51 toward the longitudinal axis A is realized by a continuous change. For this purpose, the atomization sleeve 4 has a section 56 (see FIG. 11) in which the inclination of the grooves 5 continuously changes, viewed in the direction of flow. For this purpose, the inner surface of the atomization sleeve 4 is configured as curved in the direction of flow at least in section 56 so that the inclination of the grooves 5 continuously changes here.

To generate or amplify the swirl movement, the flow channels 51 extend spirally about the longitudinal axis A, with their extent reducing in the peripheral direction in section 56, viewed in the direction of flow.

FIG. 12 shows a perspective representation of the distal end region 27 of the mixer housing 2 with the distal end 21. The distal end region 27 of the mixer housing 2 tapers toward the distal end 21. In the second embodiment, the distal end region 27 is configured as part of a rotational ellipsoid, i.e. in addition to the curvature in the peripheral direction, a curvature is also provided in the axial direction defined by the longitudinal axis A. The two regions arranged after one another viewed in the direction of the longitudinal axis A, namely the flat region 271 arranged upstream and the steeper region 272 adjoining it, are each also curved in the axial direction, that is the outer surface of the mixer housing 2 is in each case configured as a part surface of a rotational ellipsoid in the regions 271 and 272, with the curvature of the flat region 271 being smaller than the curvature of the steeper region 272. The principle of a Laval nozzle can hereby also be realized with respect to the radial direction in the second embodiment on the cooperation of the mixer housing 2 and of the atomization sleeve 4.

The invention claimed is:

1. A static spray mixer for the mixing and spraying of at least two flowable components, the static spray mixer comprising:

a tubular mixer housing comprising an outer surface, the mixer housing extending in a direction of a longitudinal axis up to a distal end that has an outlet opening for the components;

at least one mixing element arranged in the mixer housing for the mixing of the components; and an atomization sleeve comprising an inner surface that surrounds and is connected to the mixer housing in an end region, wherein the atomization sleeve comprises an inlet channel for a pressurized atomization medium, an entirety of the inlet channel being disposed in a longitudinal position relative to the mixer housing downstream of a longitudinal position of an entirety of the mixing element when the atomization sleeve is connected to the mixer housing such that the distal end of the mixer housing is downstream of a distal end of the atomization sleeve and the static spray mixer is in an operating state, wherein a plurality of grooves are provided in the outer surface of the mixer housing or in the inner surface of the atomization sleeve, wherein the grooves respectively extend toward the distal end of the mixer housing and form separate flow channels between the atomization sleeve and the mixer housing through which the atomization medium can flow from the inlet channel of the atomization sleeve to the distal end of the mixer housing, and wherein each flow channel has a respective changing inclination from the outer surface of the mixer housing or the inner surface of the atomization sleeve toward the longitudinal axis in a direction of flow.

2. A static spray mixer in accordance with claim 1, wherein each groove has three sections arranged after one another, viewed in the direction of flow, with the middle section having an inclination toward the longitudinal axis which is larger than inclinations of each of the two adjacent sections.

3. A static spray mixer in accordance with claim 2, wherein the inclination of the middle section toward the longitudinal axis is larger than 45°.

4. A static spray mixer in accordance with claim 2, wherein each groove has a section, viewed in the direction of flow, in which the inclination toward the longitudinal axis changes continuously.

5. A static spray mixer in accordance with claim 1, wherein the mixer housing has a distal end region which tapers toward the distal end of the mixer housing, and wherein the inner surface of the atomization sleeve is configured for cooperation with the distal end region.

6. A static spray mixer in accordance with claim 5, wherein the outer surface of the mixer housing is configured at least partly as a frustoconical surface or as a surface curved in an axial direction in the distal end region.

7. A static spray mixer in accordance with claim 5, wherein the distal end of the mixer housing projects beyond the atomization sleeve.

8. A static spray mixer in accordance with claim 1, wherein the flow channels have a flow cross-section first narrowing and subsequently widening, viewed in the direction of flow.

9. A static spray mixer in accordance with claim 1, wherein the grooves narrow with respect to a peripheral direction, viewed in the direction of flow.

10. A static spray mixer in accordance with claim 9, wherein the grooves extend in the peripheral direction.

11. A static spray mixer in accordance with claim 1, wherein each groove is bounded by two walls, and wherein at least one of the two walls is configured as curved, viewed in the direction of flow.

12. A static spray mixer in accordance with claim 1, wherein the grooves have a substantially spiral extent with respect to the longitudinal axis.

13. A static spray mixer in accordance with claim 1, wherein the atomization sleeve is connected in a thread-free manner to the mixer housing.

14. A static spray mixer in accordance with claim 13, wherein the inlet channel opens into the inner surface of the atomization sleeve perpendicular to the longitudinal axis.

15. A static spray mixer in accordance with claim 1, wherein the inlet channel is arranged asymmetrically with respect to the longitudinal axis.

16. A static spray mixer in accordance with claim 1, wherein the grooves are disposed on the inner surface of the atomization sleeve.

17. A static spray mixer in accordance with claim 1, wherein the atomization sleeve is tapered inwardly at the distal end thereof.

18. A static spray mixer in accordance with claim 1, wherein the mixer has a first portion with rectangular cross-section and a second portion with a round cross-section, the mixer housing transitioning from the first portion to the second portion.

19. A static spray mixer in accordance with claim 1, wherein the atomization sleeve includes a circumferential groove configured to receive an elevated continuous ring of the mixer housing.

20. A static spray mixer in accordance with claim 1, wherein the atomization sleeve is rotatable about the longitudinal axis.

* * * * *